US010899157B2

(12) United States Patent
Kubiak et al.

(10) Patent No.: US 10,899,157 B2
(45) Date of Patent: Jan. 26, 2021

(54) SYSTEM AND APPARATUS FOR BOOK BLOCK BINDING AND METHOD THEREOF

(71) Applicant: Lightning Source LLC, LaVergne, TN (US)

(72) Inventors: Peter Kubiak, Rosenheim (DE); Josef Martin Strasser, Staudach-Egerndach (DE)

(73) Assignee: Lightning Source LLC, La Vergne, TN (US)

( * ) Notice: Subject to any disclaimer, the term of this patent is extended or adjusted under 35 U.S.C. 154(b) by 0 days.

(21) Appl. No.: 16/397,584

(22) Filed: Apr. 29, 2019

(65) Prior Publication Data

US 2019/0248169 A1 Aug. 15, 2019

Related U.S. Application Data

(63) Continuation of application No. 15/700,843, filed on Sep. 11, 2017, now Pat. No. 10,272,711.

(51) Int. Cl.
*B42C 19/08* (2006.01)
*B42C 9/00* (2006.01)
(Continued)

(52) U.S. Cl.
CPC ..... *B42C 19/08* (2013.01); *B42C 5/04* (2013.01); *B42C 9/0006* (2013.01); *B42C 9/0025* (2013.01); *B42C 11/04* (2013.01)

(58) Field of Classification Search
CPC ..... B42C 19/08; B42C 9/0025; B42C 11/04; B42C 9/0006; B42C 5/04
(Continued)

(56) References Cited

U.S. PATENT DOCUMENTS 5,318,398 A 6/1994 Kojima
2009/0274536 A1* 11/2009 Silberbauer ..... B42C 11/04 412/5

(Continued)

FOREIGN PATENT DOCUMENTS

WO 03049953 A2 6/2003

OTHER PUBLICATIONS

International Search Report and Written Opinion of corresponding International Patent Application No. PCT/US2018/050216, dated Dec. 26, 2018, 17 pages.

*Primary Examiner* — Justin V Lewis
(74) *Attorney, Agent, or Firm* — Patterson Intellectual Property Law, P.C.; Edward D. Lanquist, Jr.; Grant M. Ford

(57) ABSTRACT

Systems, apparatuses, and methods are provided for providing a rotatable perfect binding separated step solution configured to maximize efficiency for one-off book printing. The multi-clamp binding apparatus includes a rotatable body, a plurality of fixed operation stations associated with the rotatable body, and a plurality of clamps coupled to the rotatable body. Each of the clamps may retain at least one workpiece. The rotatable body may rotate each of the plurality of clamps to one or more of the plurality of fixed operation stations. In operation, a book block is received at an in-feed location of the perfect binding apparatus. The book block is stored within a holding apparatus of the perfect binding apparatus. The book block is then rotated between a plurality of fixed operation stations. At least one operation is performed upon the book block at each of the plurality of fixed operation stations.

20 Claims, 14 Drawing Sheets

(51) Int. Cl.
*B42C 11/04* (2006.01)
*B42C 5/04* (2006.01)

(58) Field of Classification Search
USPC .... 412/1, 4, 6, 9, 19, 20, 21, 25, 29, 32, 33, 412/37
See application file for complete search history.

(56) References Cited

U.S. PATENT DOCUMENTS

| | | | |
|---|---|---|---|
| 2011/0058917 | A1 | 3/2011 | Walian et al. |
| 2013/0213766 | A1 | 8/2013 | Tas et al. |

* cited by examiner

SYSTEM AND APPARATUS FOR BOOK BLOCK BINDING AND METHOD THEREOF

CROSS-REFERENCES TO RELATED APPLICATIONS

This is a continuation application of U.S. patent application Ser. No. 15/700,843 filed Sep. 11, 2017, entitled "System and Apparatus for Book Block Binding and Method Thereof," which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to systems and apparatuses for book block binding and methods thereof. More particularly, the present invention relates to providing a rotatable perfect binding solution having separated steps for maximizing efficiency for book block printing.

Existing binder concepts suffer numerous deficiencies. One such binder concept is to provide continuous movement. In systems implementing continuous movement, processes and clamp transportation may occur continuously. However, the processes must be synchronized to clamp, and the clamp speed is limited to the milling speed. As such, there is limited speed for thick books and the transportation time is equal to the process cycle. This solution results in complex synchronization and unnecessary wear.

Another existing binder solution relates to implementing processes while both moving and standing still. In this case, the clamp speed is equal to the milling speed and thus provides limited speed for thick books. A nipping operation may be performed while a book block is standing still, thus the nipping time plus the transportation time is equal to the process cycle. One benefit of this solution is that no synchronization is required. Although this is a straight-forward solution, it is a very slow process comparatively.

A further existing binder solution involves using independent clamps. In this solution, clamp movement and the nipping process are decoupled, thus no synchronization is necessary. However, the solution requires a complex clamp moving system.

BRIEF SUMMARY OF THE INVENTION

A need exists in the art to address the deficiencies in the prior art and to provide capabilities for providing a binding solution permitting format changes from book-to-book on the fly and for quick changeover between formats. One solution described herein relates to implementing a system having only one cover size, which is modified as part of the binding process. Printed products produced according to the present disclosure may be generated with no overhang of the cover after binding and with the highest possible book quality. The solutions provided herein also have the benefit of being operator-friendly.

For implementations consistent with the present disclosure, the functions of processing at a process station and transportation to the next process station are separated. All processes, with the potential exception of applying side glue, may be performed simultaneously in the same work step. The clamps holding the book blocks are not required to move during the work step. A relative movement between a milling blade and a book block is necessary in the milling station. In common binder solutions, the book block is moved by the clamp through the milling. However, in implementations consistent with the present disclosure, the clamp is not required to move. Instead, the milling station may be configured to move rather than the clamp holding the book block. The same is true for glue application. In common binder systems, glue is applied by moving the clamp relative to the glue applicators. However, in implementations consistent with the present disclosure, the clamp is not required to move. Instead, the glue station (spine and side) may be configured to move relative to the book block.

In various systems, no process is performed while the transportation step is in motion. The process stations (such as, for example, milling and gluing stations) may return to their respective start position simultaneously with the clamp moving one step. One advantage of this separated step process is the fact that all clamps are moved at once and all can be statically chained or mounted on the rotating table without any loss of time caused by the two processes of milling and nipping.

Implementations consistent with the present disclosure are capable of decoupling binding processes and book block transport. There may be relative movement for milling and gluing through process station movement. There may be a high transportation speed between stations with implementations consistent with the present disclosure, and one or more formats associated with a book block may be changed while transporting the book block between processes. By performing all processes simultaneously in the manner described herein, binding may be fast, fully variable, and provide moveable process station capabilities.

One aspect of the present disclosure relates to a multi-clamp binding apparatus. The multi-clamp binding apparatus includes a rotatable body, a plurality of fixed operation stations associated with the rotatable body, and a plurality of clamps coupled to the rotatable body. Each of the plurality of clamps may be configured to retain at least one workpiece. The rotatable body may rotate each of the plurality of clamps to one or more of the plurality of fixed operation stations.

Another aspect of the present disclosure relates to a method of providing a completed book by a perfect binding apparatus. The method begins by receiving a book block at an in-feed location of the perfect binding apparatus. The book block is stored within a holding apparatus of the perfect binding apparatus. The book block is then rotated between a plurality of fixed operation stations. At least one operation is performed upon the book block at each of the plurality of fixed operation stations. A completed book is output at an out-feed location of the perfect binding apparatus.

A further aspect of the present disclosure relates to a system for providing perfect binding. The system includes a base section having plurality of fixed operation stations and a rotatable section having a plurality of clamps. Each of the plurality of clamps may retain at least one book block and may correspond to at least one of the plurality of fixed operation stations. The rotatable body is configured to rotate each of the plurality of clamps to one or more of the plurality of fixed operation stations. Each of the fixed operation stations may perform at least one operation corresponding to the book block.

Numerous other objects, features, and advantages of the present invention will be readily apparent to those skilled in the art upon a reading of the following disclosure when taken in conjunction with the accompanying drawings

DETAILED DESCRIPTION OF THE INVENTION

Figure 1:
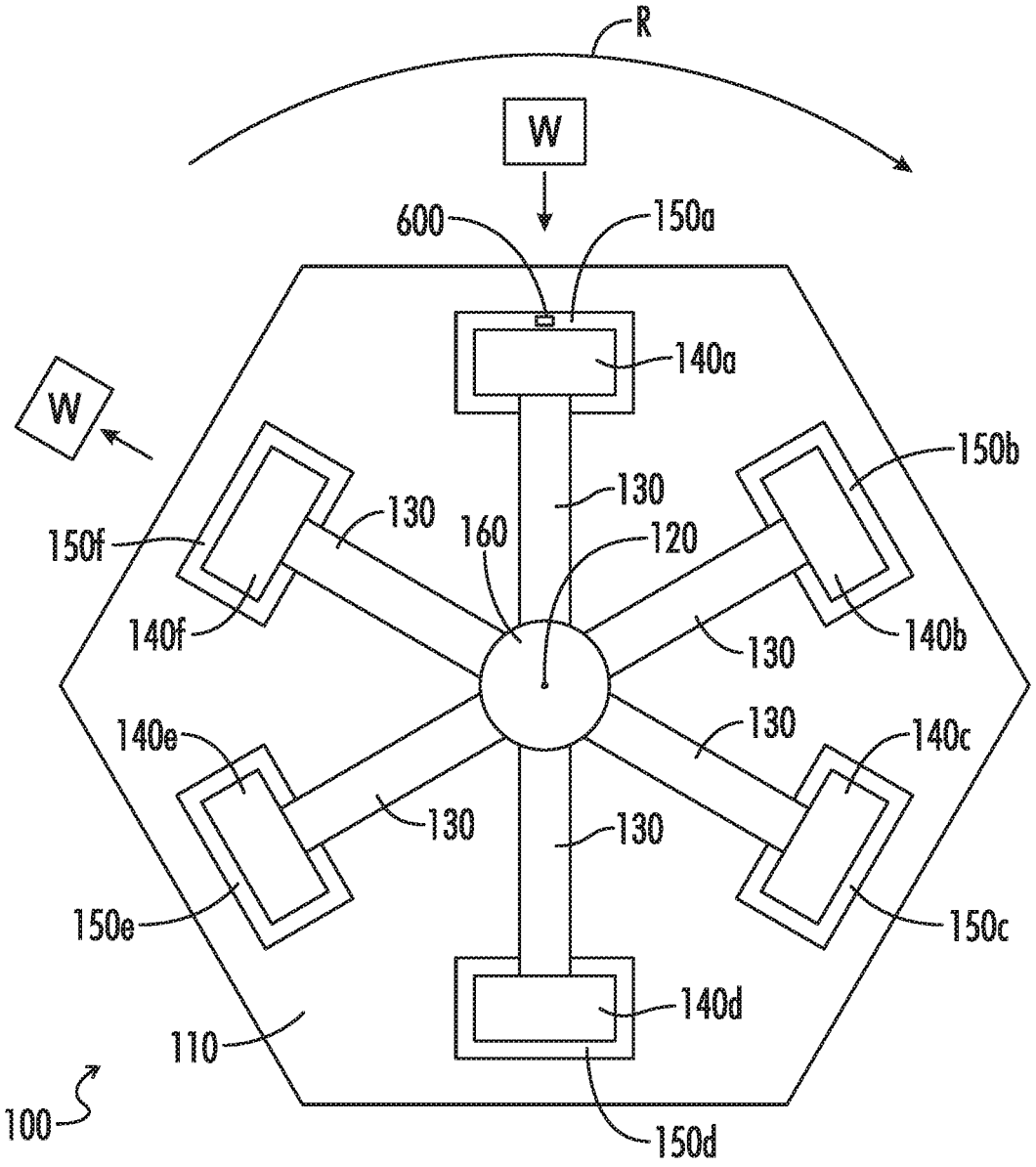
FIG. 1 illustrates a partial top view of an exemplary embodiment of a perfect binding apparatus according to aspects of the present disclosure.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-14, exemplary systems, apparatuses, and methods for providing systems, apparatuses, and methods for book block binding. Where the various figures may describe embodiments sharing various common elements and features with other embodiments, similar elements and features are given the same reference numerals and redundant description thereof may be omitted below.

Figure 2:
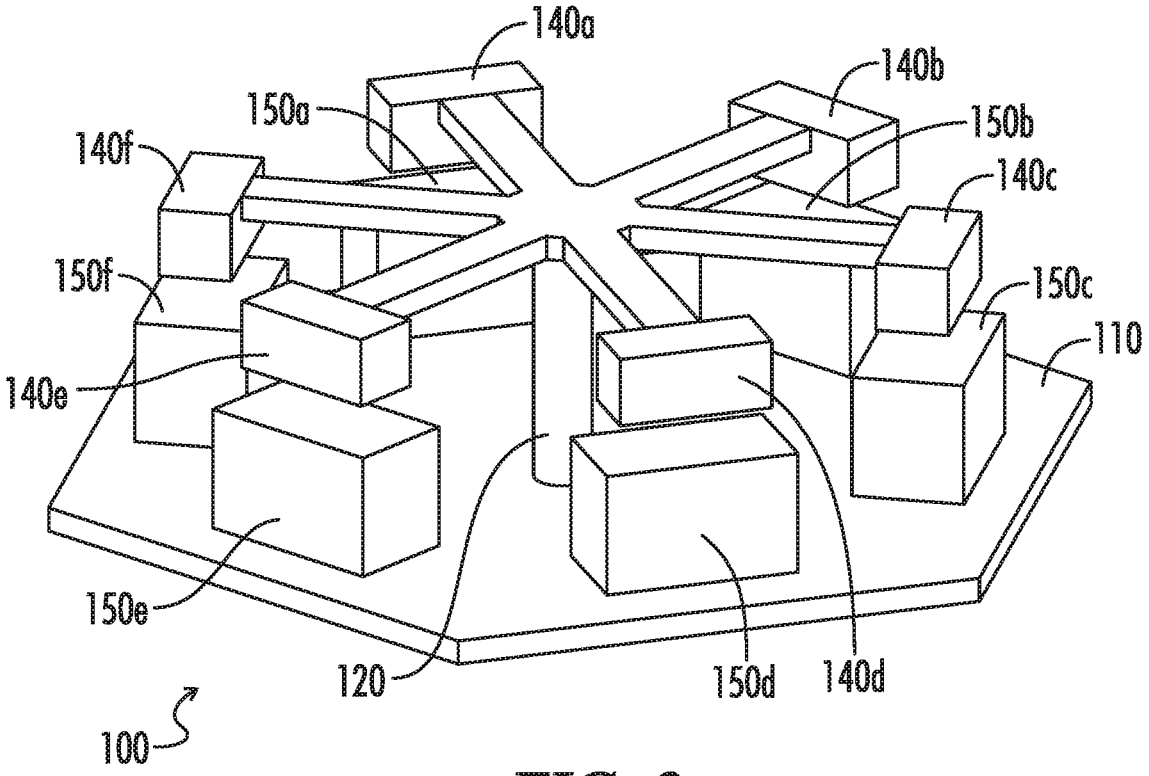
FIG. 2 illustrates a partial raised perspective view of the perfect binding apparatus of FIG. 1 according to aspects of the present disclosure.

FIG. 1 illustrates a partial top view of an exemplary embodiment of a perfect binding apparatus 100 according to aspects of the present disclosure. The apparatus 100 includes a base section 110 having a plurality of fixed operation stations 150*a-f*. Although illustrated and described with reference to the base section 110, it should be appreciated that one or more of the plurality of fixed operation stations 150*a-f* may be located external to the base section 110, and that one or more of the plurality of fixed operation stations 150*a-f* may be moveably configured in various embodiments. The apparatus 100 further includes a rotatable section 160 including rotatable body 130 having a plurality of clamps 150*a-f*. The rotatable body 130 is configured to rotate in a rotation direction R about a pivot point 120 in one exemplary embodiment. FIG. 2 illustrates a partial raised perspective view of the perfect binding apparatus of FIG. 1, according to aspects of the present disclosure.

The perfect binding apparatus 100 of FIGS. 1 and 2 includes six fixed operation stations 150*a-f*. The fixed operation stations 150*a-f* may include one or more devices for performing an operation on a workpiece W. The workpiece W may be a book block, printed product or portion thereof, or any other element capable of being sequentially processed using the apparatus 100. The fixed operation stations 150 may include one or more of an in-feed station 150*a*, a jogging station 150*b*, a milling station 150*c*, a glue station 150*d*, a cover station 150*e*, and/or a delivery station 150*f*. One or more of the fixed operation stations 150*a-f* may include an empty station, or may include a plurality of operations and/or stations corresponding to a single fixed operation station 150. Although illustrated as having six stations, it should be appreciated that the apparatus 100 may include any number of fixed operation stations 150 without departing from the spirit and the scope of the present disclosure. Furthermore, although illustrated in a circular configuration, one or more of the fixed operating stations 150 may be located at any point within the base section 110.

The in-feed station 150*a* may be configured to receive at least one workpiece W from an external source. The in-feed station 150*a* may include at least one gripper 600 as described below with reference to FIG. 6. The gripper 600 may be configured to receive the workpiece W (e.g., book block) from an external source such as a conveyor. The workpiece W may be received by the in-feed station 150*a* at a receipt angle. The gripper 600 may be configured to rotate the workpiece W to a particular angle or position relative to the receipt angle. For example, the gripper 600 may rotate the workpiece W to a vertical configuration for use with the apparatus 100 (e.g., from a horizontal configuration to a vertical configuration). The gripper 600 may be configured to measure a thickness of the received workpiece W by placing a surface of an adjustable portion of the gripper 600 in contact with a surface of the workpiece W. The gripper 600 may be configured to move at least a portion of the workpiece W to the clamp 140*a*, located at the in-feed station 150*a* in FIGS. 1 and 2.

The jogger 150*b* may be configured to receive a workpiece W via a clamp 140 of the apparatus 100 and/or from an internal or external source. The jogger 150*b* may be an oscillating conveyor in one exemplary embodiment. The jogger 150*b* may be configured to align and transport at least a portion of the workpiece W towards a registration edge. The jogger 150*b* may operate by receiving a workpiece W from a clamp 140 configured to provide the workpiece W to the jogger 150*b*. The received workpiece W may be jogged along a length of the oscillating conveyor to the registration edge of the oscillating conveyor, where the clamp 140 may close, thereby securing the workpiece W. The workpiece W may then be transported via rotation of the clamp 140 to at least one other of the fixed operation stations 150, provided to an internal or external storage location, etc.

The milling station 150*c* may be configured to receive a workpiece W via a clamp 140 of the apparatus 100 and/or from an internal or external source. The milling station 150*c* may include a milling housing 420*c* having a milling device. The milling station 150*c* may be configured to create a rough surface on the workpiece W, for example to optimize glue adhesion. In one exemplary embodiment, the milling station 150*c* is configured to mill a spine of the workpiece W. One or more components of the milling station 150*c* may be selected for or, as implemented, result in minimized formation of dust during milling and/or dust and waste removal from a spine of the workpiece.

The milling station 150*c* may include a milling motor 422 and/or a track 424. The milling station 150*c* may further include a milling transport section (e.g., milling motor 422 and/or track 424) configured to place the milling housing 420*c* in contact with a workpiece W and to transport the milling housing 420*c* relative to the workpiece W during at least a portion of a milling operation. For example, the milling housing 420*c* may be coupled to a track 424 or other conveyance means capable of transporting the milling housing 420*c*. The milling housing 420*c* may be configured to move in a direction D1 using the milling motor 422 and the track 424. Although described with reference to a milling motor 422 and track 424, it should be appreciated that the milling transportation section is not limited solely to a motor/track configuration, but any means of conveying the milling housing 420*c* along the direction D1.

In one exemplary embodiment, the apparatus 100 is configured to hold the workpiece W stationary in the clamp 140*c* while the milling operation is performed by causing the milling housing 420*c* to be placed in contact with the workpiece W and transported across a surface of the workpiece W. For example, the clamp 140*c* may be configured to hold the workpiece W in a configuration where the spine may be contacted by the milling housing 420*c* when the milling housing 420*c* is moved along the direction D1 during a milling operation. Additional detail regarding the milling station 150*c* is described below with reference to FIG. 7.

Figure 8:
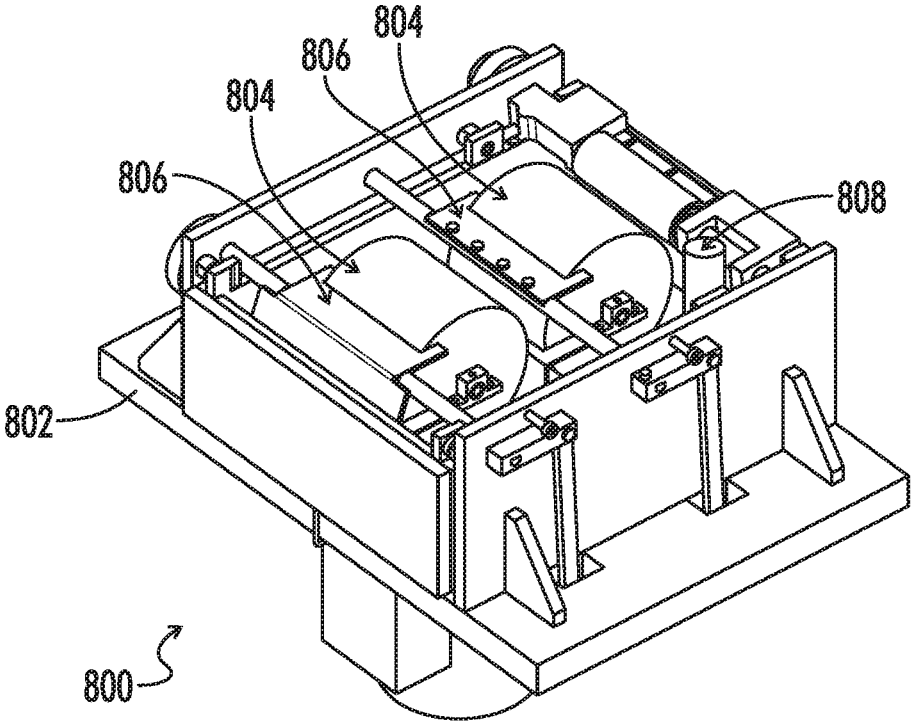
FIG. 8 illustrates a raised perspective view of an exemplary embodiment of a portion of a glue station.

The glue station 150*d* may be configured to receive a workpiece W via a clamp 140 of the apparatus 100 and/or from an internal or external source. FIG. 8 illustrates a raised perspective view of an exemplary embodiment of a portion of a glue station 150*d*. The glue station 150*d* may include at least one of a housing 802, a drum 804, a scraper 806 and/or a fill level sensor 808. The glue station 150*d* may be configured to apply at least one portion of glue to a surface of the workpiece W. For example, the glue station 150*d* may be configured to apply glue to a spine of the workpiece W. The glue station 150*d* may include a glue storage (not illustrated) coupled to otherwise accessible by the drum 804 and the fill level sensor 808. The drum 804 is configured to apply glue to at least a portion of the workpiece W. The scraper 804 is configured to control the start and stop positions of glue application by the drum 804 and to remove excess glue applied by the drum 804. An angle of the scraper 806 may be configured to control the applied glue thickness.

In one exemplary embodiment, the glue applied by the glue station 150*d* is an ethylene-vinyl acetate (EVA) hotmelt glue, although any glue or tacky substance capable of functioning as described herein may be used within the spirit and the scope of the present disclosure. In the exemplary embodiment illustrated by FIG. 8, there are two drums 804 and two scrapers 806, although a single instance or a plurality of each of the drum 804 and/or the scraper 806 may be implemented in various embodiments. One or more of the drums 804 may be configured as or in conjunction with a heated spinner to smoothen glue applied to the workpiece W.

Figure 9:
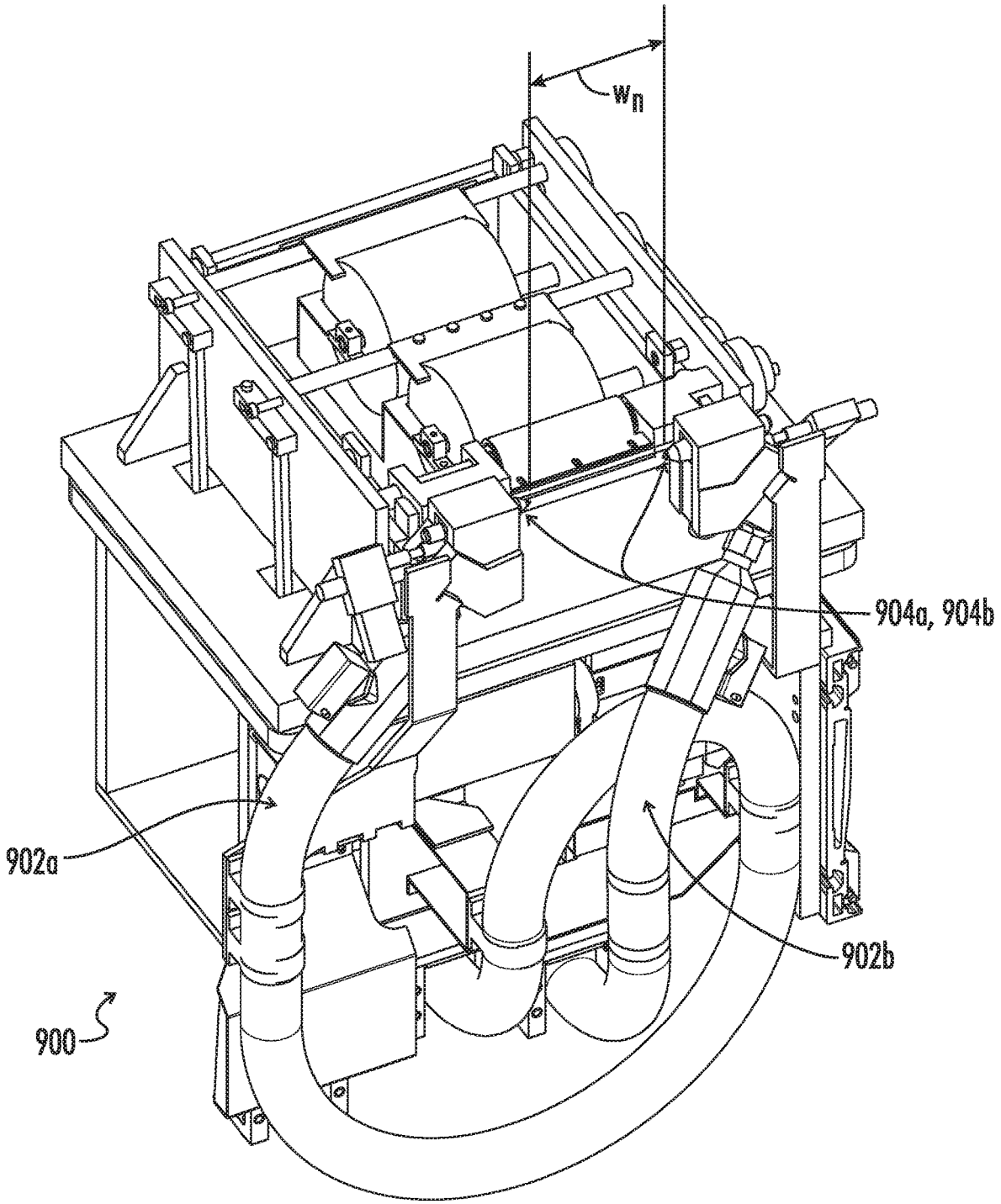
FIG. 9 illustrates a raised side perspective view of an exemplary embodiment of a side glue section according to aspects of the present disclosure.

In addition or alternative to applying glue to a spine of the workpiece W, glue may be applied to at least one side of the workpiece W by a side glue section. FIG. 9 illustrates a raised side perspective view of an exemplary embodiment of a side glue section 900 according to aspects of the present disclosure. The side glue section 900 includes first and second glue input tubes 902*a*, 902*b* respectively coupled to first and second nozzles 904*a*, 904*b*. The side glue section 900 may be configured to apply glue from at least one of the first and second glue input tubes 902*a*, 902*b* to at least one surface of the workpiece W using at least one of the first and second nozzles 904*a*, 904*b*. The nozzles 904*a*, 90*b* may be configured to oppose one another over a width $w_n$ corresponding to a width of the workpiece W. In various embodiments, the side glue section 900 may be configured with a single nozzle 904 or with a plurality of nozzles 904. Although illustrates and described with reference to opposing locations, it should be appreciated that one or more nozzle 904 may be independently located relative to one or more other nozzles 904 and that one or more nozzles 904 may be configured not to provide glue during one or more operations of the side glue section 900.

The side glue section 900 may be configured to use an EVA hotmelt glue or any other glue or tacky substance capable of functioning as described herein may be used. Use of one or more nozzles 904 enables the side glue section 900 to provide precise start and stop locations for glue application and to provide precise glue usage based, for example, on nozzle attributes such as opening size and angle relative to the workpiece W. The width $w_n$ may be automatically or manually determined and/or implemented, for example according to a width of the workpiece W. In one or more instances, the side glue section 900 may be configured to allow a workpiece W to pass through the section without applying any glue. The side glue section 900 may include one or more needle valves (not illustrated) to avoid excess glue dripping from one or more needles 904. One or more of the glue input tubes 902 may be selected based at least in part upon one or more properties specified for continuous movement.

Figure 10:
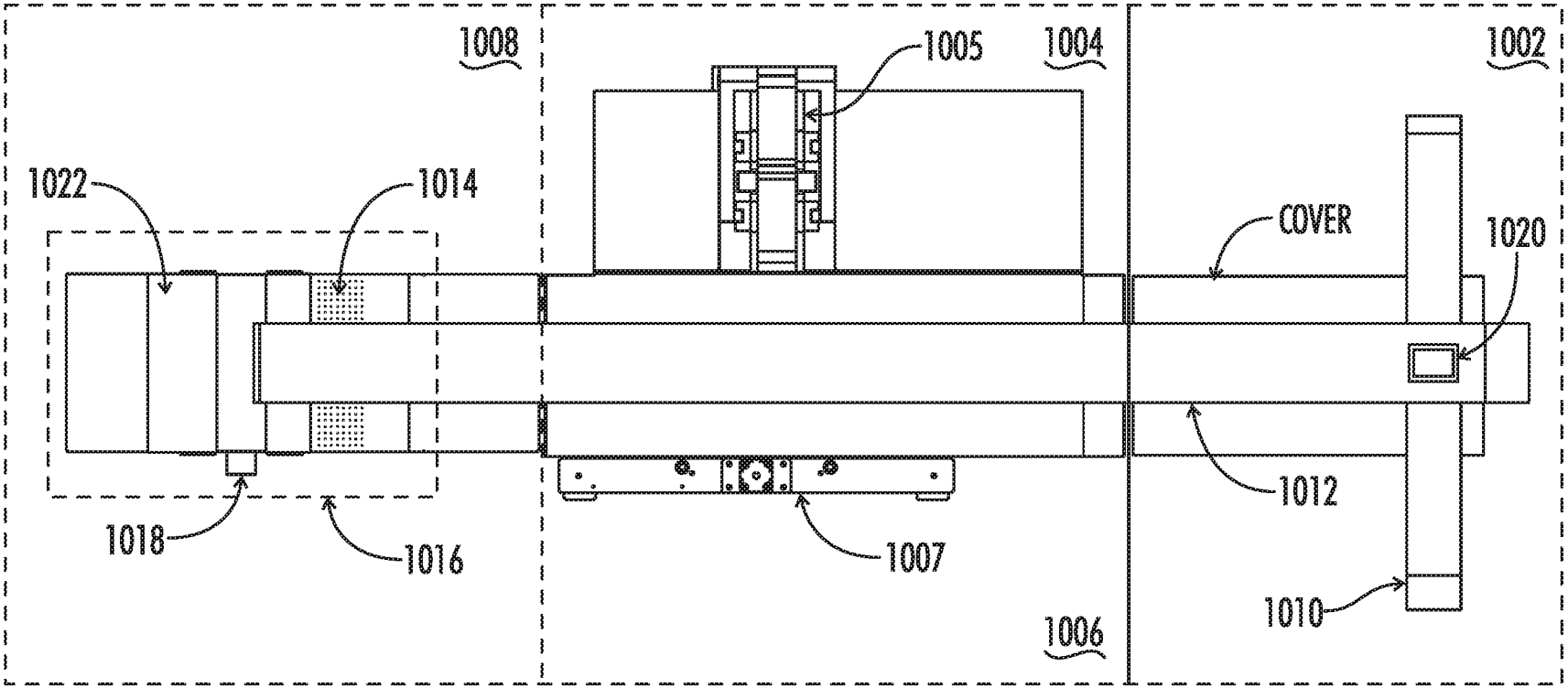
FIG. 10 illustrates a top view of an exemplary embodiment of a cover station according to aspects of the present disclosure.

The cover station 150*e* may be configured to receive a workpiece W via a clamp 140 of the apparatus 100 and/or from an internal or external source. FIG. 10 illustrates a top view of an exemplary embodiment of a cover station 1000 according to aspects of the present disclosure. The cover station 150*e* may include at least one of an input section 1002, a scoring section 1004, a pre-trim cut section 1006, a nipping station 1008, and/or a gripper 1010. The input section 1002 may be configured to receive a cover, either as manual input or as automatically fed into the cover station

150*e* from an internal or external source. The cover received at the cover station 150*e* may be transported between two or more sections of the cover station 150*e* by the gripper 1010. The gripper 1010 may be coupled to a track 1012 or other conveyance means configured to permit the gripper 1010 to be transported between areas of the cover station 150*e*. Although described as a track, it should be appreciated that the gripper 1010 may be moved according to any means of motion, whether track-based or not, without departing from the spirit and scope of the present disclosure.

The scoring section 1004 may include at least one scoring device 1005, configured to selectively perform at least one scoring operation on a cover received at the input section 1002. The gripper 1010 may be configured to convey the cover to the scoring section 1004 for operation. In one exemplary embodiment, the scoring section 1004 may perform at least one scoring operation on the cover as the gripper 1010 transports the cover by the scoring section 1004 along the track 1012, and according to an orientation of the cover as held by the gripper 1010. The pre-trim cut section 1006 may include at least one cutting section 1007. The pre-trim cut section 1006 may be configured to perform at least one cutting operation on the cover. For example, the pre-trim cut section may be configured to reduce a size of the cover according to one or more parameters associated with the cover and/or an orientation of the cover as held by the gripper 1010.

The nipping station 1008 may include one or more of a suction plate 1014, a pressing station 1016, and a lifting motor 1018. The nipping station 1008 may be configured to receive the cover from the gripper 1010. The suction plate 1014 may be configured to hold the cover in place during at least a portion of operation of the cover station 150*e*. The pressing station 1016 may include an adjustable pressing plate 1020 and a fixed pressing plate 1022. Both of the adjustable pressing plate 1020 and the fixed pressing plate may be configured to be positioned and/or moved according to at least one property of a workpiece W. For example, in one exemplary embodiment, at least one of the adjustable pressing plate 1020 and the fixed pressing plate 1022 may be positioned according to a width of a workpiece to be operated upon by the nipping station 1008. The lifting motor 1018 may be configured to operate as a servo in one embodiment. Cover overhang may be trimmed prior to completed workpiece delivery (e.g., by the cover station 150*e* and/or delivery station 150*f*).

At least one component of the cover station 150*e* may include or otherwise have access to a processor 1020 configured to perform or coordinate at least one operation. In one exemplary embodiment, the processor 1020 determines at least one of a position or a relative orientation of at least a portion of the cover relative to the workpiece W in conjunction with the gripper 1010 (e.g., by wireless identification such as by obtaining a radio frequency (RF) tag identifier, scanning an image obtained by the gripper 1010 or other element of the apparatus 100, etc.). At least one operation of the scoring section 1004 and/or pre-trim cut section 1006 may be performed based at least in part upon the determined at least one of a position or a relative orientation of at least a portion of the cover relative to the workpiece W.

Unlike in common perfect binders, in various embodiments consistent with the present disclosure, the cover is not required to be conveyed using rollers and guides. Instead, the gripper 1010 may control movement of the cover (e.g., as mounted on a portal or industrial multiple axle robot). The cover may be either manually or automatically placed at a pick-up position for the gripper 1010. At least one of a position and/or an orientation of a print mark and thus for the image is obtained, identified, or determined before the gripper 1010 picks up the cover in one embodiment. Additionally or alternatively, the position or orientation may be provided to the cover station 150*e* from an internal or external source, or may be determined while the cover is in transit in the possession of the gripper 1010. As such, it is not the locations of a paper's edges that triggers the exact pick up position for the gripper 1010. Therefore, the tolerances in sheet size or position of an image on the sheet is irrelevant.

The gripper 1010 may be configured to know or determine the exact position and orientation of an image or print mark associated with a cover and can transport the cover to at least one of the scoring section 1004 and/or the pre-trim cut section 1006. During operations of the scoring section 1004 and/or the pre-trim cut section 1006, the gripper 1010 may be configured to hold the cover at all times to ensure correct positioning. After the operations are completed, the gripper 1010 may be configured to position the prepared cover on the nipping station 1008. There, the cover is hold in position by either a suction (e.g., vacuum) plate or another kind of holding mechanism to avoid any slipping when the gripper 1010 releases the cover. This ensures the position of the scoring and the position of the cover image to the workpiece.

Figure 11:
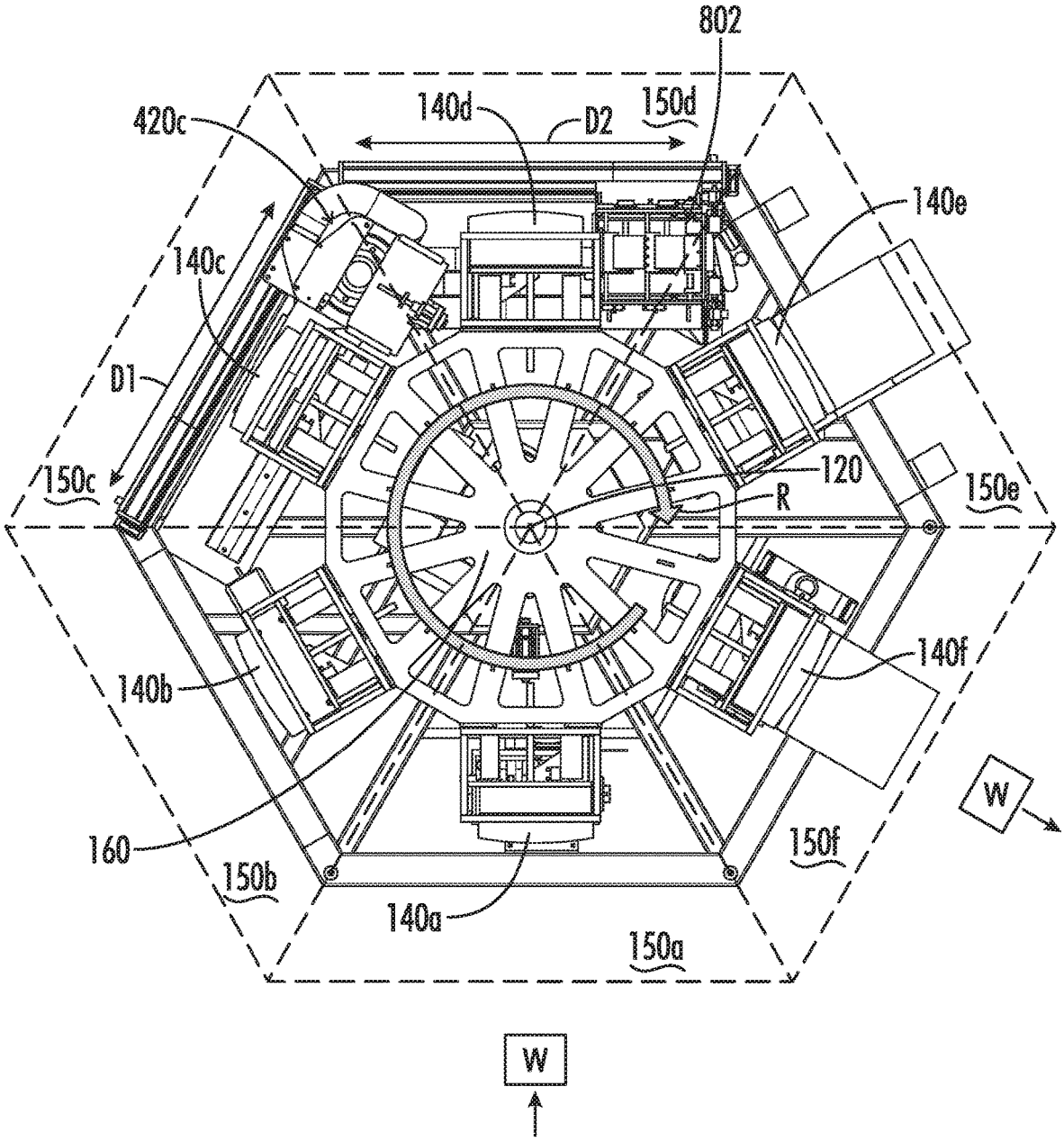
FIG. 11 illustrates a top view of an exemplary embodiment of a perfect binding apparatus according to aspects of the present disclosure.

FIG. 11 illustrates overhead top view of an exemplary embodiment of a perfect binding apparatus 1100 according to aspects of the present disclosure. Similar to the exemplary embodiment illustrated in FIGS. 1 and 2, the perfect binding apparatus 1100 includes an in-feed station 150*a*, a jogging station 150*b*, a milling station 150*c*, a glue station 150*d*, a cover station 150*e*, and/or a delivery station 150*f*. A workpiece W may be received at the in-feed station 150*a*, operated upon by one or more of the jogging station 150*b*, the milling station 150*c*, the glue station 150*d*, the cover station 150*e*, and/or the delivery station 150*f*. One or more devices associated with one or more of the in-feed station, the jogging station 150*b*, the milling station 150*c*, the glue station 150*d*, the cover station 150*e*, and/or the delivery station 150*f* may be mounted to, coupled to, or otherwise associated with the base section 110.

The exemplary embodiment illustrated by FIG. 11 further illustrates a milling housing 420*c* included with the milling station 150*c* and the movement direction D1 associated with movement of the milling housing 420*c* during a milling operation. FIG. 11 further illustrates a housing 802 of the glue station 150*d*, along with the movement direction D2 associated with movement of the housing 802 of the glue station 150*d*. One or more components of the milling station 150*c* and/or the glue station 150*d* may be connected to, coupled to, or otherwise associated with at least one of the base section 110 and the rotatable section 160. In one exemplary embodiment, at least a portion of each of the milling station 150*c* and the glue station 150*d* are coupled to the base section 110. The workpiece W is configured to be received at the in-feed station 150*a* and output by the delivery station 150*f* in the embodiment illustrated by FIG. 11.

Figure 3:
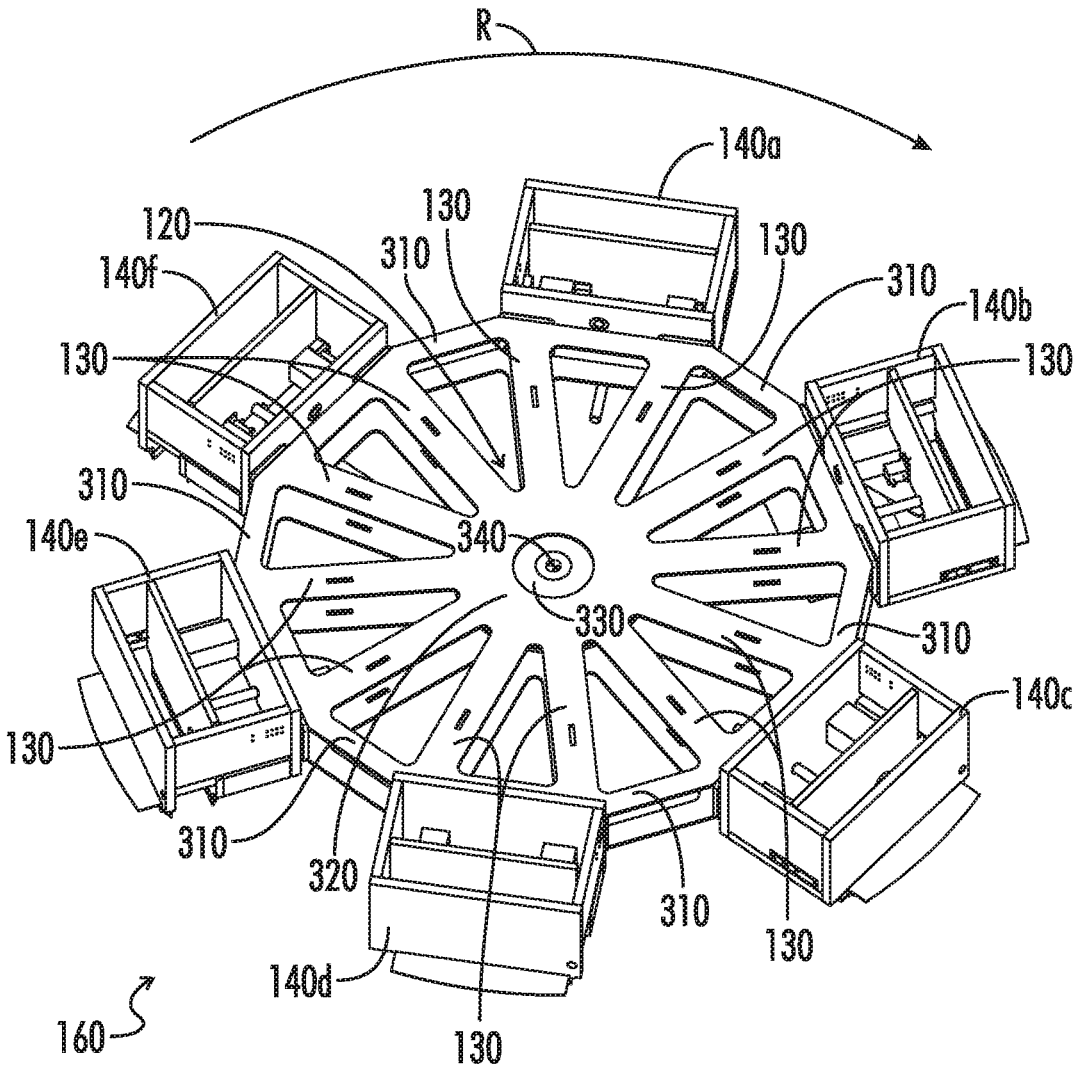
FIG. 3 illustrates a partial raised perspective view of an exemplary embodiment of a rotatable section according to aspects of the present disclosure.

FIG. 3 illustrates a partial raised perspective view of an exemplary embodiment of a rotatable section 160 according to aspects of the present disclosure. The rotatable section 160 includes the plurality of clamps 140*a-f* coupled to a plurality of arms of rotatable body 130. Although illustrated as being located at an outer extent of each arm of the rotatable body 130, it should be appreciated that one or more of the clamps 140*a-f* may be located at any location along any of the arms of the rotatable body 130 in various embodiments. The rotatable section 160 may include one or more crossmembers 310 configured to connect one or more sections of the rotatable body 130. The rotatable section 160 further includes a central portion 320. Within the central portion 320 is a rotation means 330 having a rotation pivot point 340. The rotation means 330 may be any structure or entity configured to cause the rotatable section 160 to rotate about the pivot point 340. For example, the rotation means 330 may include a motor configured to cause the rotatable section to rotate as described herein. Additionally or alternatively, the rotation means 330 may include a section coupled to a source of rotation, such as an external motor (e.g., as provided by the base section 110).

Figure 4:
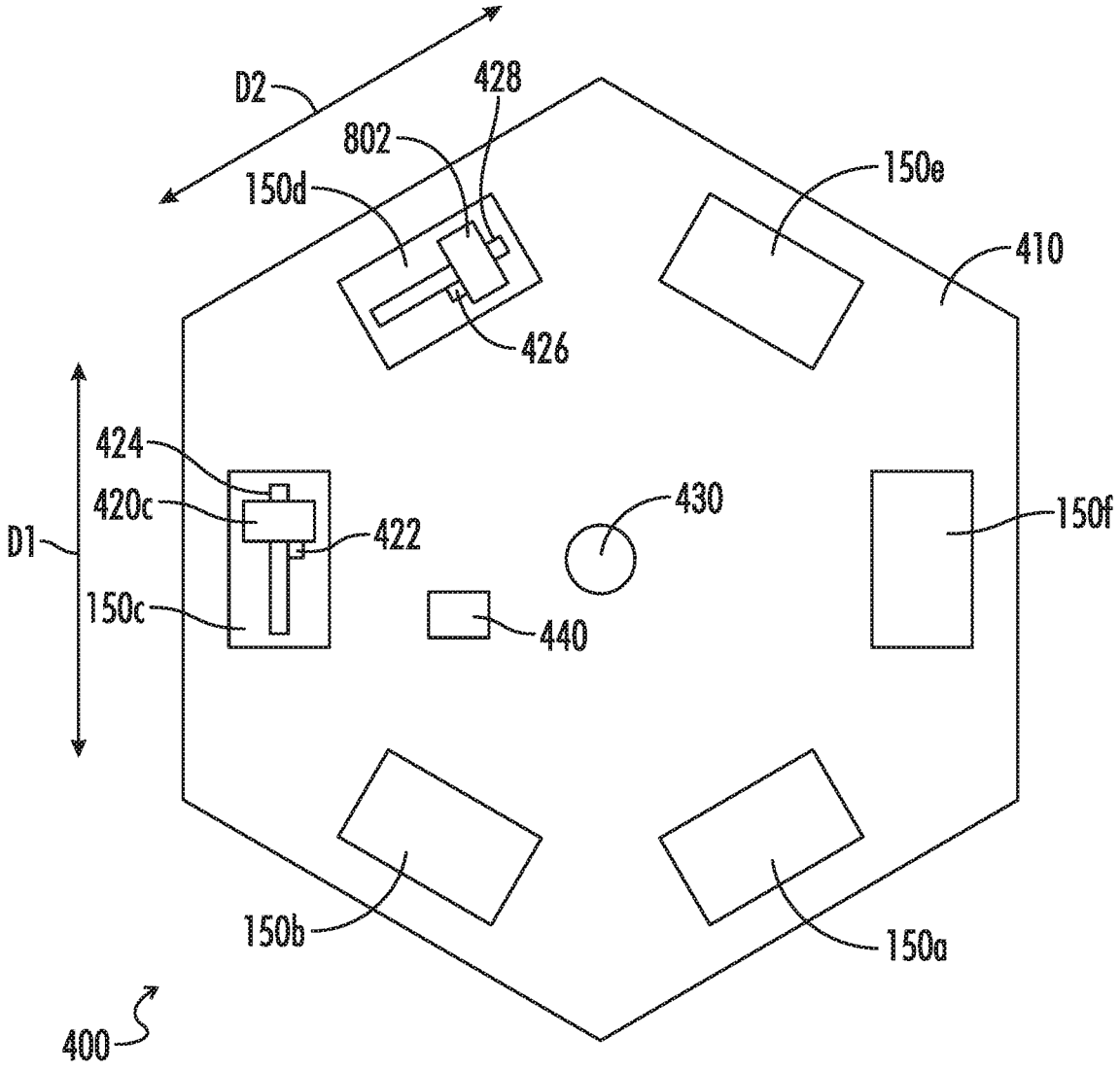
FIG. 4 illustrates a partial raised perspective view of an exemplary embodiment of a base section according to aspects of the present disclosure.

FIG. 4 illustrates a partial raised perspective view of an exemplary embodiment of a base section 400 according to aspects of the present disclosure. The base section 400 includes a housing 410, a central pivot 430, and/or a control unit 440. One or more fixed operation stations 150*a*-150*f* may be coupled to or otherwise associated with the base section 400 as previously described herein. The central pivot 430 may be configured to provide rotative energy to the rotatable section 160 (e.g., via a motor associated with the base section 400) in one embodiment. Additionally or alternatively, the central pivot 430 may be configured to remain stationary or to rotate based at least in part upon rotation associated with the rotatable section 160 when the rotatable section 160 is in contact with the central pivot 430. FIG. 4 also illustrates the movement direction D1 associated with movement of the milling housing 420*c* and the movement direction D2 associated with movement of the housing 802 of the glue station 150*d*. The milling station 150*c* may further include a motor 422 associated with the milling housing 420*c* and configured to provide movement power and control to the milling housing 420*c* during operation. Similarly, the glue station 150*d* may include a motor 426 associated with the housing 802 and configured to provide movement power and control to the housing 802 during operation.

The control unit 440 may include one or more processors or devices configured to control one or more operations associated with at least one of the rotatable section 160 and/or the base section 400. Additionally or alternatively, the control unit 440 may be configured to operate in accordance with one or more operations or control signals received from an external entity (e.g., a remote computer or controller) via one or more wired or wireless public or private communications networks. Although illustrated and described with reference to the base section 440, it should be appreciated that one or more portions or operations associated with the control unit 440 may be implemented at any physical location or remote location associated with the apparatus 100, without departing from the spirit and the scope of the present disclosure.

Figure 5:
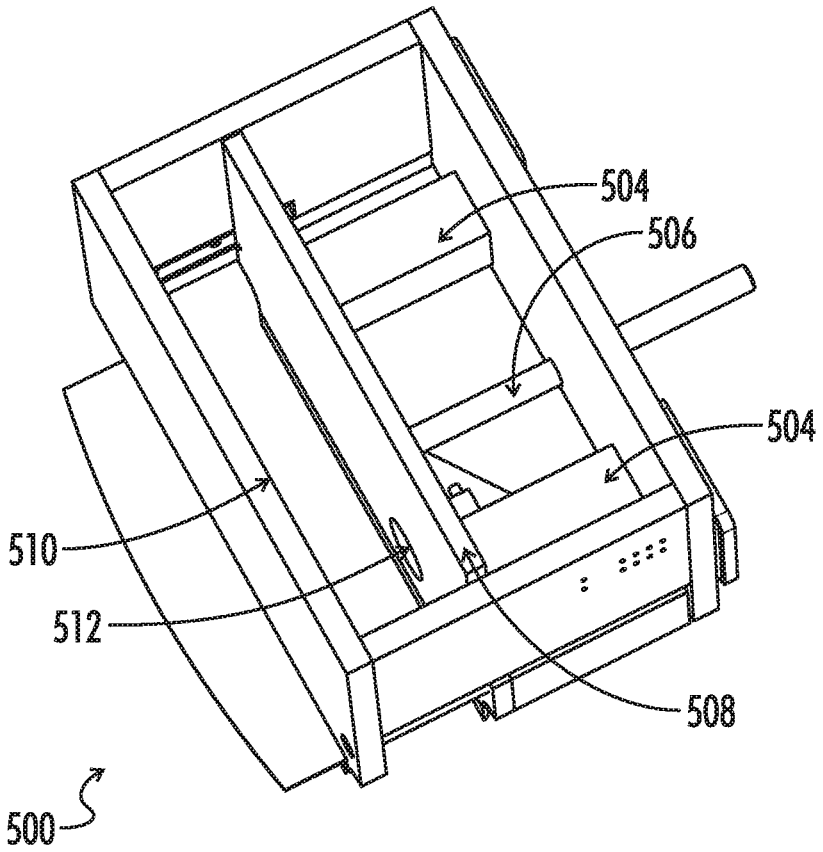
FIG. 5 illustrates a raised perspective view of an exemplary embodiment of a clamp according to aspects of the present disclosure.

FIG. 5 illustrates a raised perspective view of an exemplary embodiment of a clamp 500 according to aspects of the present disclosure. The clamp 500 includes a body 502 and at least one of a pressing cylinder 504, a pusher 506, a pressing plate 508, a fixed edge 510, and an opener cylinder 512. The clamp 500 may be coupled to the raised section 160 in one exemplary embodiment. The pressing cylinder(s) 504 may be coupled to the pressing plate 508 via the pusher 506. The workpiece W may be configured to be held in place between the fixed edge 510 and the pressing plate 508 via movement of the pressing plate 508 via the pressing cylinder 504. The pressing cylinder(s) 504 may be controlled by at least one control unit associated with the clamp 500 and/or a processor or control unit communicatively coupleable to the clamp 500 (e.g., control unit 440 or other controller or processor). As noted above, the clamp 500 may be configured to measure a thickness of a workpiece W at the in-feed station 150*a* or at any point during operation of the apparatus 100.

Figure 6:
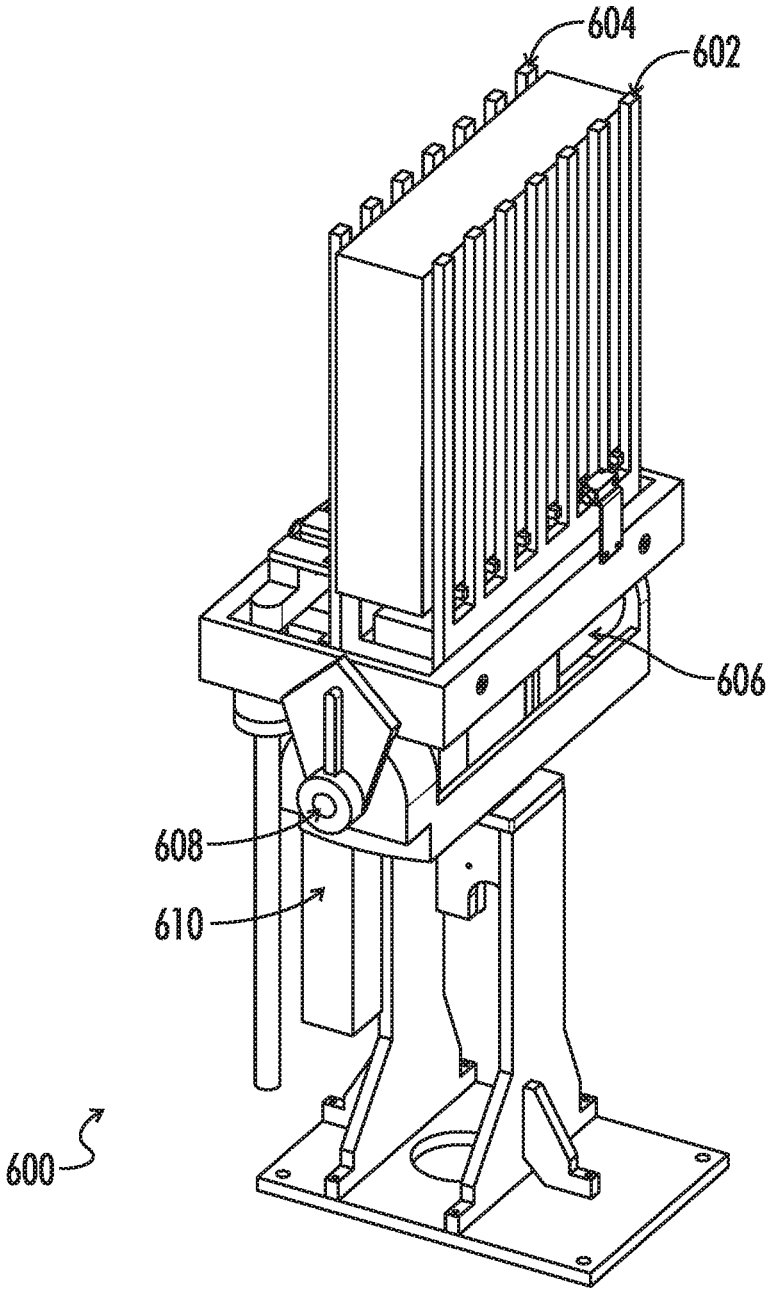
FIG. 6 illustrates a side perspective view of an exemplary embodiment of a gripper according to aspects of the present disclosure.

FIG. 6 illustrates a side perspective view of an exemplary embodiment of a gripper 600 according to aspects of the present disclosure. The gripper 600 includes one or more of a fixed side 602, an adjustable side 604, an adjustment motor 606, a rotation motor 608, and a lifting cylinder 610. The gripper 600 may be controlled by at least one control unit associated with the gripper 600 (not illustrated) and/or a processor or control unit communicatively coupleable to the gripper 600 (e.g., control unit 440 or other controller or processor). The gripper 600 may be configured to provide angular rotation as preciously described using the rotation motor 608. A distance between the adjustable side 604 and the fixed side 602 may be modified using the adjustment motor 606 by adjusting a position of the adjustable side 604 relative to the fixed side 602. During operation, a workpiece W received at the in-feed station 150*a* may be placed between the adjustable side 604 and the fixed side 602 for transporting to the clamp 140*a*. The gripper 600 may be configured to hold the workpiece W, as received, to rotate the workpiece W to a vertical configuration, to place the rotated workpiece W at least partially into the clamp 140*a*, and to selectively release the workpiece W for transfer to the clamp 140*a*.

Figure 7:
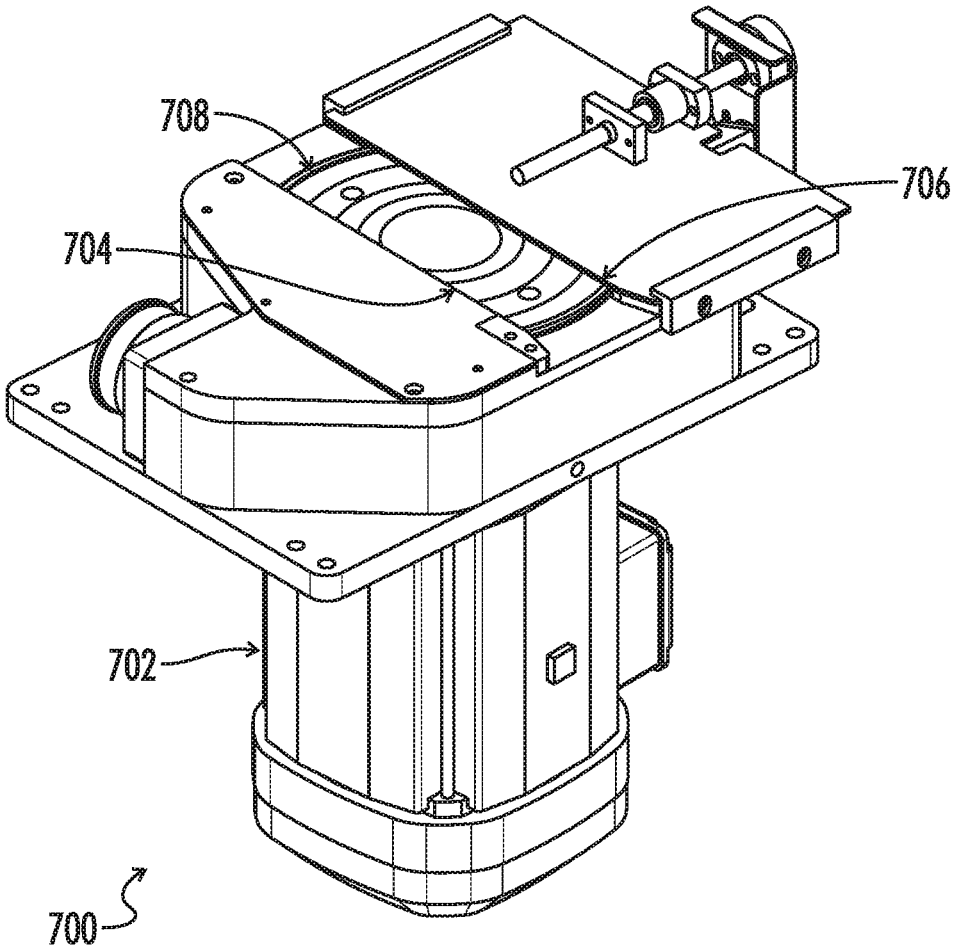
FIG. 7 illustrates a partial raised perspective view of an exemplary embodiment of a mill for use by a milling station according to aspects of the present disclosure.

FIG. 7 illustrates a partial raised perspective view of an exemplary embodiment of a mill for use by a milling station 150*c* according to aspects of the present disclosure. The mill 700 includes a milling device 708 coupled to a milling motor 702. The mill further includes a fixed end stop 704 and an adjustable press-edge 706. A distance between opposing surfaces of the fixed end stop 704 and the adjustable press edge 706 may be adjusted to correspond to a width of a workpiece W operated upon by the mill 700. Adjustment to the width between the fixed end stop 704 and the adjustable press edge 706 may be performed either manually or automatically by the mill 700 (e.g., by means of a control signal generated or received by the mill 700 or by physical displacement of the adjustable press edge 706 by the workpiece W as it is operated upon by the mill 700.

Figure 12:
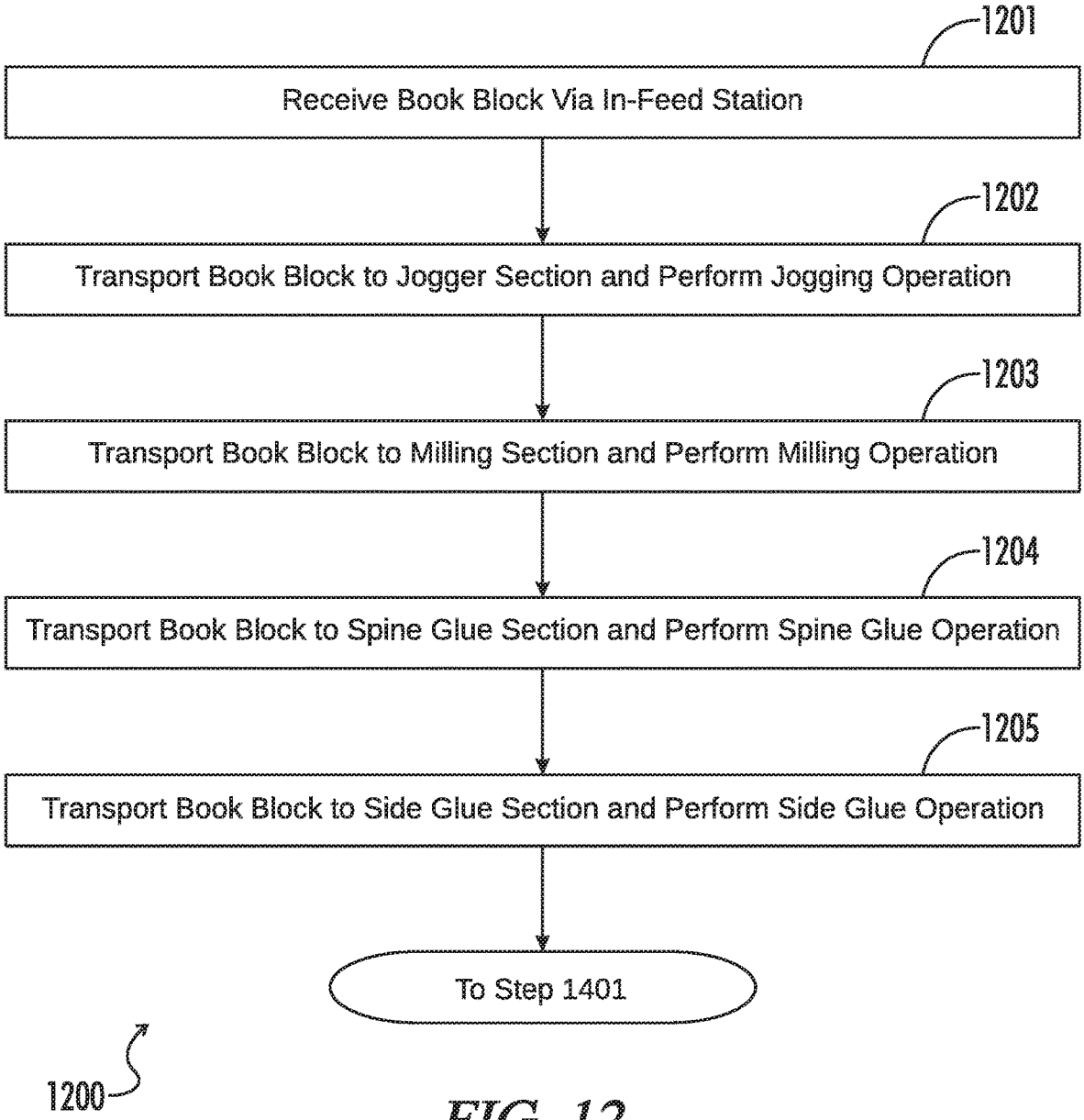
FIG. 12 illustrates an exemplary embodiment of a process for processing a book block according to aspects of the present disclosure.

FIG. 12 illustrates an exemplary embodiment of a process for processing a book block according to aspects of the present disclosure. The process 1200 begins at a step 1201, where a book block is received via the in-feed station of a perfect binding apparatus. The process continues to a step 1202, where the book block is transported to a jogger section of the perfect binding apparatus, which performs a jogging operation on the book block. At a step 1203, the book block is transported to a milling section of the perfect binding apparatus and a milling operation is selectively performed on the book block. The book block is then transported to a spine glue section at a step 1204, where the spine glue section selectively performs a spine glue operation. The process then continues to a step 1205, where a book block is optionally transported to a side glue section which performs a side glue operation on the book block. The process then continues to step 1401.

Figure 13:
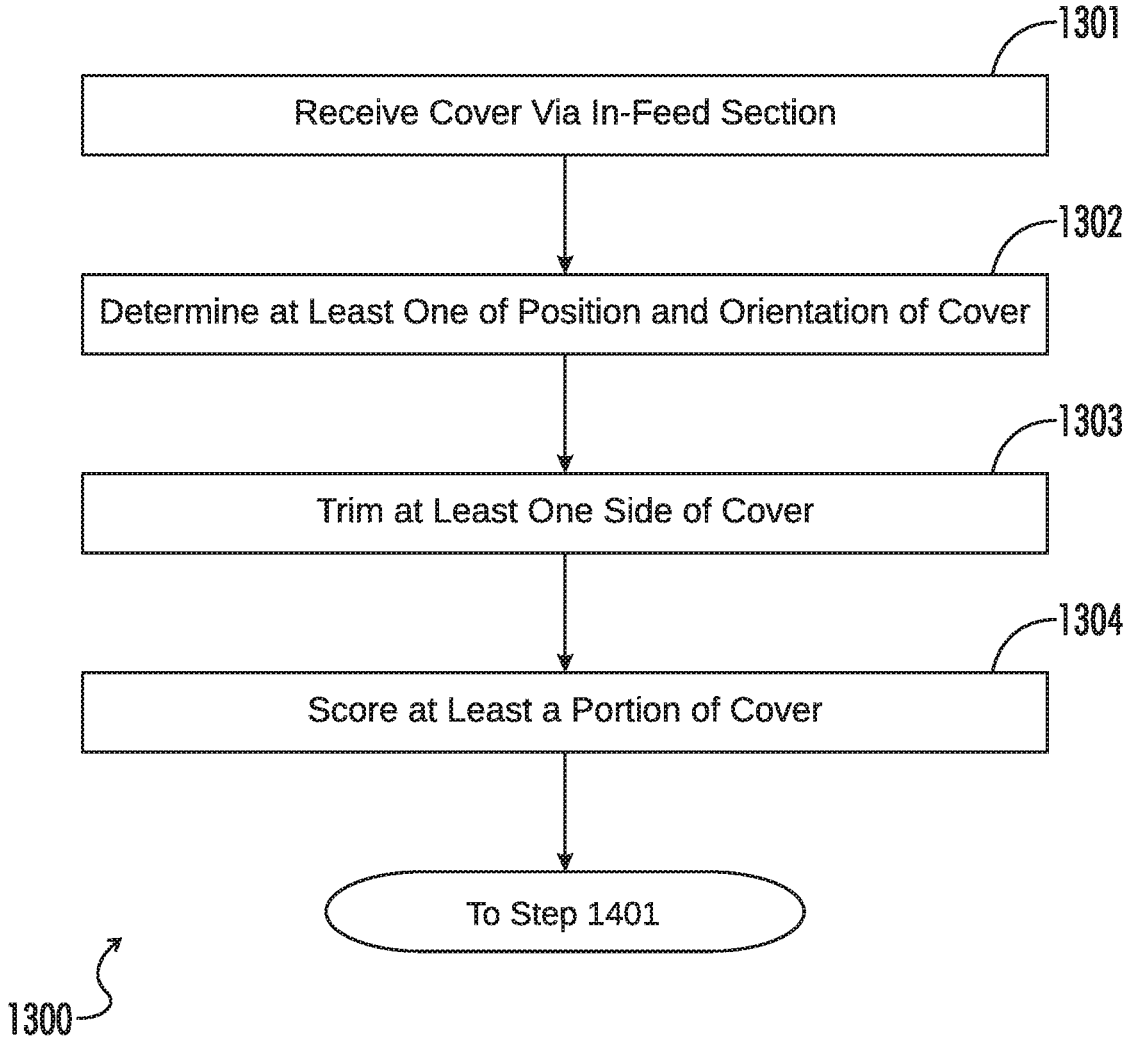
FIG. 13 illustrates an exemplary embodiment of a process for processing a cover according to aspects of the present disclosure.

FIG. 13 illustrates an exemplary embodiment of a process for processing a cover according to aspects of the present disclosure. The process 1300 begins at a step 1301, where a cover is received at an in-feed section associated with a cover station. At least one of a position and an orientation of the cover is/are determined at step 1302. The process continues to step 1303, where at least one side (e.g., the long side) of the cover is trimmed. At least a portion of the cover is scored at step 1304. The process then continues to step 1401. A gripper associated with the cover station may be used to determine the at least one position or orientation, and may further be configured to transport the cover at a determined orientation for operations of the cover station.

Figure 14:
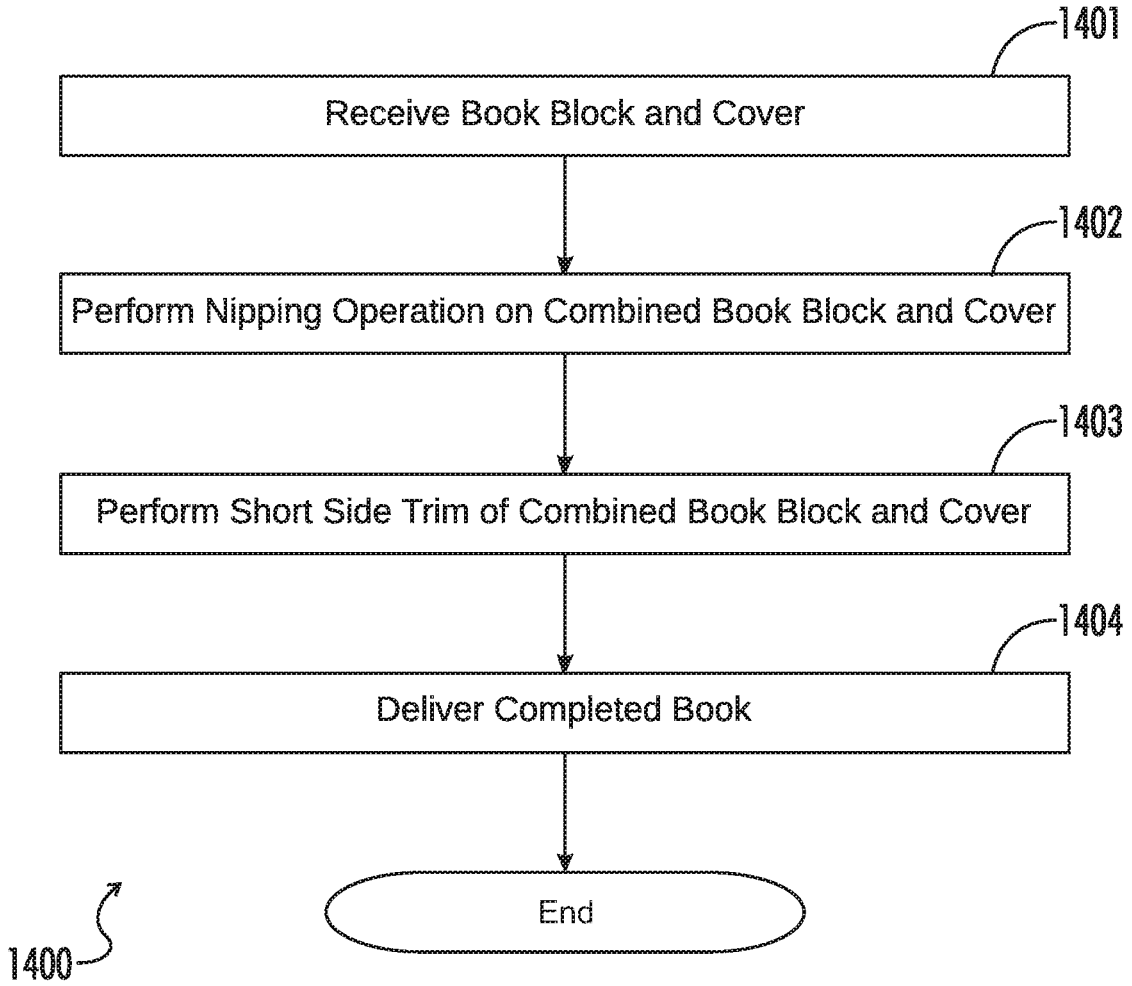
FIG. 14 illustrates an exemplary embodiment of a process for processing a combined book block and cover according to aspects of the present disclosure.

FIG. 14 illustrates an exemplary embodiment of a process for processing a combined book block and cover according to aspects of the present disclosure. The process 1400 begins at a step 1401, where a book block and cover are received by a cover station. The book block may be received at the cover station from a clamp of a perfect binding apparatus. The cover may be received at an in-feed section of the cover station. A nipping operation may be performed on the combined book block and cover at a step 1402. A short side trim of the combined book block and cover may be performed at a step 1403. A completed book may be delivered at a step 1404. The completed book may be delivered, for example, to or via a delivery station configured to output the completed book.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus," may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A multi-clamp binding apparatus, comprising:
- a moveable body;
- a plurality of operation stations associated with the moveable body; and
- a plurality of retaining portions coupled to the moveable body, each of the plurality of retaining portions configured to retain at least one workpiece,
- wherein the moveable body is configured to move two or more of the plurality of retaining portions to one or more of the plurality of operation stations,
- wherein the plurality of operation stations includes a cover station, the cover station comprising:
  - an input section configured to receive a cover;
  - a scoring section;
  - a pre-trim cut section;
  - a nipping section; and
  - a gripper configured to transport a cover between two or more of the input section, the scoring section, the pre-trim cut section, and the nipping section, and
- wherein the nipping section comprises:
  - a suction plate configured to hold the cover in place during at least a portion of operation of the cover station;
  - a pressing section; and
  - a lifting motor configured to place the cover in contact with the at least one workpiece.

2. The apparatus of claim 1, wherein the plurality of operation stations comprises an in-feed station, a jogging station, a milling station, a glue station, a cover station, and a delivery station.

3. A multi-clamp binding apparatus, comprising:
- a moveable body;
- a plurality of operation stations associated with the moveable body; and
- a plurality of retaining portions coupled to the moveable body, each of the plurality of retaining portions configured to retain at least one workpiece,
- wherein the moveable body is configured to move two or more of the plurality of retaining portions to one or more of the plurality of operation stations,
- wherein the plurality of operation stations includes a cover station, the cover station comprising:
  - an input section configured to receive a cover;
  - a scoring section;
  - a pre-trim cut section;
  - a nipping section; and
  - a gripper configured to transport a cover between two or more of the input section, the scoring section, the pre-trim cut section, and the nipping section, and
- wherein the plurality of operation stations comprises a cover station, the cover station comprising:
  - an input section configured to receive a cover;
  - an orientation processor configured to determine at least one of a position or a relative orientation of at least a portion of the cover relative to the at least one workpiece; and
  - a pre-trim cut section configured to trim the cover to a predetermined layout; and
  - a nipping section having a suction plate configured to hold the cover in place during at least a portion of operation of the cover station in accordance with the determined at least one of the position or the relative orientation of the at least a portion of the cover relative to the at least one workpiece.

4. The apparatus of claim 3, wherein the plurality of operation stations comprises an in-feed station, a jogging station, a milling station, a glue station, a cover station, and a delivery station.

5. A multi-clamp binding apparatus, comprising:

a moveable body;

a plurality of operation stations associated with the moveable body; and a plurality of retaining portions coupled to the moveable body, each of the plurality of retaining portions configured to retain at least one workpiece, wherein the moveable body is configured to move two or more of the plurality of retaining portions to one or more of the plurality of operation stations, wherein the plurality of operation stations includes a cover station, the cover station comprising:

an input section configured to receive a cover;

a scoring section;

a pre-trim cut section;

a nipping section; and a gripper configured to transport a cover between two or more of the input section, the scoring section, the pre-trim cut section, and the nipping section, and wherein the plurality of operation stations comprises a milling station, the milling station comprising:

a milling housing having a mill; and a milling transport section configured to place the milling housing in contact with the at least one workpiece and to transport the milling housing relative to the at least one workpiece during at least a portion of a milling operation.

6. A multi-clamp binding apparatus, comprising:

a moveable body;

a plurality of operation stations associated with the moveable body; and a plurality of retaining portions coupled to the moveable body, each of the plurality of retaining portions configured to retain at least one workpiece, wherein the moveable body is configured to move two or more of the plurality of retaining portions to one or more of the plurality of operation stations, wherein the plurality of operation stations includes a cover station, the cover station comprising:

an input section configured to receive a cover;

a scoring section;

a pre-trim cut section;

a nipping section; and a gripper configured to transport a cover between two or more of the input section, the scoring section, the pre-trim cut section, and the nipping section, and wherein the plurality of operation stations comprises a glue station, the glue station comprising:

a glue housing having a drum and a scraper; and a glue transport section configured to place the drum in contact with the at least one workpiece and to transport the glue housing relative to the at least one workpiece during at least a portion of a glue operation to apply a glue to the at least one workpiece.

7. The apparatus of claim 6, wherein the apparatus comprises a plurality of drums and a plurality of scrapers.

8. The apparatus of claim 6, wherein the glue station further comprises:

a glue storage;

a glue input tube coupled to the glue storage; and a fill level sensor configured to measure a glue level of the glue storage and to receive additional glue via the glue input tube when the measured glue level drops below a minimum threshold.

9. The apparatus of claim 6, wherein the glue station further comprises:

a side glue section having first and second glue input tubes respectively coupled to first and second nozzles, wherein the side glue section is configured to apply glue from at least one of the first and second glue input tubes to at least one surface of the at least one workpiece using at least one of the first and second nozzles.

10. The apparatus of claim 9, wherein the side glue section is configured to apply glue to opposing outer surfaces of the at least one workpiece.

11. A method of providing a completed book by a perfect binding apparatus, the method comprising:

receiving a book block at the perfect binding apparatus;

storing the book block within a retaining portion of the perfect binding apparatus;

moving the book block between a plurality of operation stations;

performing at least one operation upon the book block at two or more of the plurality of operation stations; and outputting a completed book at an out-feed location of the perfect binding apparatus, wherein the performing at least one operation upon the book block at two or more of the plurality of operation stations comprises:

receiving a cover at a cover station of the plurality of operation stations;

determining at least one of a position or a relative orientation of at least a portion of the cover relative to the book block;

selectively performing a pre-trim operation to trim the cover to a predetermined layout;

holding the cover in place at the cover station in a spatial configuration corresponding to the determined at least one of a position or relative orientation;

placing the book block in contact with the cover; and performing a nipping operation on the book block and the cover.

12. A system for providing perfect binding, comprising:

a base section having plurality of operation stations; and a moveable section having a plurality of clamps, each of the plurality of clamps configured to retain at least one book block, wherein the moveable section is configured to move at least two of the plurality of clamps to one or more of the plurality of operation stations, and wherein each of the plurality of operation stations is configured to perform at least one operation corresponding to the at least one book block, wherein the plurality of operation stations includes a cover station, the cover station comprising:

an input section configured to receive a cover;

a scoring section;

a pre-trim cut section;

a nipping section; and a gripper configured to transport a cover between two or more of the input section, the scoring section, the pre-trim cut section, and the nipping section, wherein the nipping section comprises:

a suction plate configured to hold the cover in place during at least a portion of operation of the cover station;

a pressing section; and a lifting motor configured to place the cover in contact with the at least one book block.

13. The system of claim 12, wherein the plurality of operation stations comprises an in-feed station, a jogging station, a milling station, a glue station, a cover station, and a delivery station.

14. A system for providing perfect binding, comprising:

a base section having plurality of operation stations; and a moveable section having a plurality of clamps, each of the plurality of clamps configured to retain at least one book block, wherein the moveable section is configured to move at least two of the plurality of clamps to one or more of the plurality of operation stations, and wherein each of the plurality of operation stations is configured to perform at least one operation corresponding to the at least one book block, wherein the plurality of operation stations includes a cover station, the cover station comprising:

an input section configured to receive a cover;

an orientation processor configured to determine at least one of a position or a relative orientation of at least a portion of the cover relative to the at least one book block; and a pre-trim cut section configured to trim the cover to a predetermined layout; and a nipping section having a suction plate configured to hold the cover in place during at least a portion of operation of the cover station in accordance with the determined at least one of the position or the relative orientation of the at least a portion of the cover relative to the at least one book block.

15. The system of claim 14, wherein the plurality of operation stations comprises an in-feed station, a jogging station, a milling station, a glue station, a cover station, and a delivery station.

16. A system for providing perfect binding, comprising:

a base section having plurality of operation stations; and a moveable section having a plurality of clamps, each of the plurality of clamps configured to retain at least one book block, wherein the moveable section is configured to move at least two of the plurality of clamps to one or more of the plurality of operation stations, and wherein each of the plurality of operation stations is configured to perform at least one operation corresponding to the at least one book block, and wherein the plurality of operation stations includes a milling station, the milling station comprising:

a milling housing having a mill; and a milling transport section configured to place the milling housing in contact with the at least one book block and to transport the milling housing relative to the at least one book block during at least a portion of a milling operation.

17. A system for providing perfect binding, comprising:

a base section having plurality of operation stations; and a moveable section having a plurality of clamps, each of the plurality of clamps configured to retain at least one book block, wherein the moveable section is configured to move at least two of the plurality of clamps to one or more of the plurality of operation stations, and wherein each of the plurality of operation stations is configured to perform at least one operation corresponding to the at least one book block, and wherein the plurality of operation stations comprises a glue station, the glue station comprising:

a glue housing having a drum and a scraper; and a glue transport section configured to place the drum in contact with the at least one book block and to transport the glue housing relative to the at least one book block during at least a portion of a glue operation to apply a glue to the at least one book block.

18. The system of claim 17, wherein the glue station comprises a plurality of drums and a plurality of scrapers.

19. The system of claim 17, wherein the glue station further comprises:

a glue storage;

a glue input tube coupled to the glue storage; and a fill level sensor configured to measure a glue level of the glue storage and to receive additional glue via the glue input tube when the measured glue level drops below a minimum threshold.

20. The system of claim 17, wherein the glue station further comprises:

a side glue section having first and second glue input tubes respectively coupled to first and second nozzles, wherein the side glue section is configured to apply glue from at least one of the first and second glue input tubes to at least one surface of the at least one book block using at least one of the first and second nozzles.

* * * * *